US006976291B2

(12) United States Patent
Kimoto et al.

(10) Patent No.: US 6,976,291 B2
(45) Date of Patent: Dec. 20, 2005

(54) TAPE-MOUNTED FASTENER AND METHODS FOR MANUFACTURING AND USING THE SAME

(75) Inventors: Masato Kimoto, Chuo-ku (JP); Yoshihiro Chihara, Amagasaki (JP); Sadao Miyoshi, Amagasaki (JP)

(73) Assignee: Morito Co., Ltd., Osaka (JP)

( * ) Notice: Subject to any disclaimer, the term of this patent is extended or adjusted under 35 U.S.C. 154(b) by 206 days.

(21) Appl. No.: 10/371,473

(22) Filed: Feb. 21, 2003

(65) Prior Publication Data

US 2003/0200633 A1 Oct. 30, 2003

(30) Foreign Application Priority Data

Apr. 30, 2002 (JP) ..... 2002-128719
Jun. 27, 2002 (JP) ..... 2002-188124

(51) Int. Cl.[7] ..... A44B 1/04; A44B 1/32

(52) U.S. Cl. ..... 24/114.4; 24/93; 24/108; 24/114.5; 24/114.6; 24/302

(58) Field of Search ..... 24/114.4, 114.6, 24/662, 693, 692, 114.12, 114.05, 114.8, 108, 107, 93, 94, 302, 357

(56) References Cited

U.S. PATENT DOCUMENTS 1,270,494 A * 6/1918 Christiansen ..... 24/302
2,157,011 A 5/1939 Perry
2,895,199 A * 7/1959 Jones ..... 24/662
3,561,074 A * 2/1971 Mosher, Jr. et al. ..... 24/662
4,000,746 A * 1/1977 Fierst ..... 450/102
4,398,317 A * 8/1983 Schubring ..... 24/302
5,103,538 A * 4/1992 Ryder ..... 24/662
6,314,621 B1 11/2001 Kawahara
6,353,978 B1 * 3/2002 Kawahara et al. ..... 24/114.4
6,434,801 B2 * 8/2002 Grunberger ..... 24/114.6
2001/0001181 A1 5/2001 Akashi et al.

FOREIGN PATENT DOCUMENTS

DE 1 018 365 10/1957

* cited by examiner

*Primary Examiner*—Jack W. Lavinder
(74) *Attorney, Agent, or Firm*—Merchant & Gould P.C.

(57) ABSTRACT

A male-mounted tape is composed of a plurality of synthetic resin male snaps moulded and fastened onto a cloth tape at certain intervals in such a way that their engagement sides and non-engagement sides, which are asymmetric to each other, are on the front side and the back side of the cloth tape respectively. A female tape is composed of a plurality of synthetic resin female snaps moulded and fastened onto a cloth tape at the same intervals as the male snaps in such a way that their engagement sides and non-engagement sides, which are asymmetric to each other, are on the front side and the back side of the cloth tape respectively. The cloth tapes, on which the female and male snaps are formed and fastened, are not provided with holes for mounting the snaps. The engagement sides and the non-engagement sides of the male snaps coexist on both the front side and the back side of the male tape, and the engagement sides and the non-engagement sides of the female snaps coexist on both the front side and the back side of the female tape.

8 Claims, 14 Drawing Sheets

FIG. 3 (a-1)
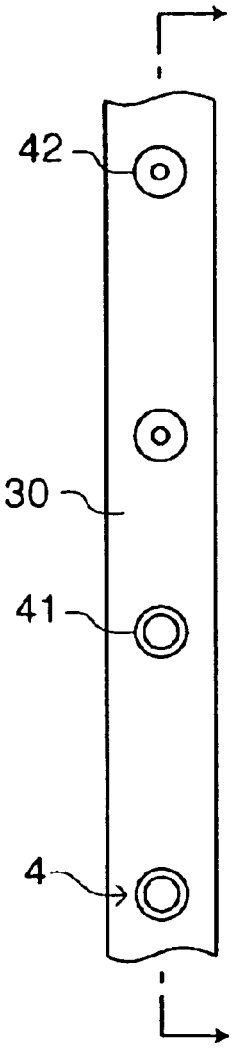
FIG. 3 (a-2)
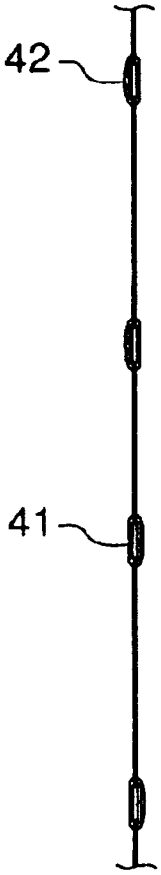
FIG. 3 (b-1)
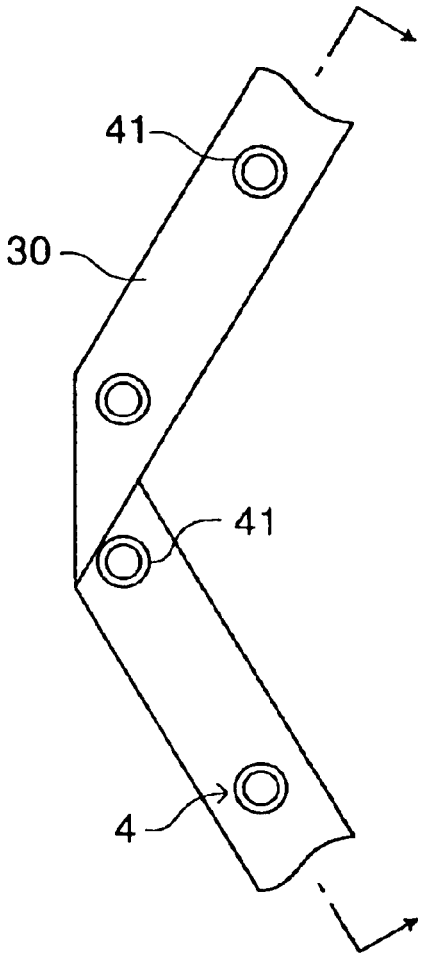
FIG. 3 (b-2)
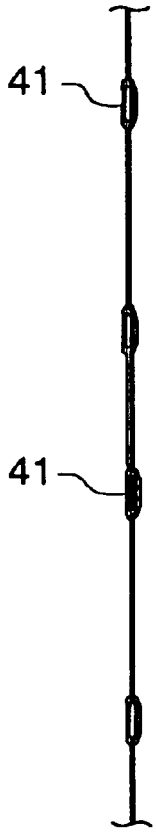

FIG. 4 (a-1)
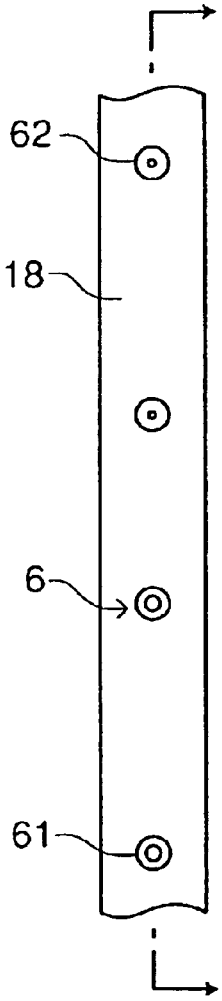
FIG. 4 (a-2)
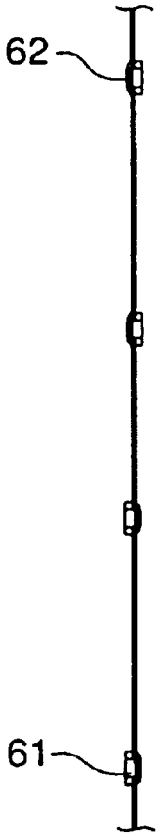
FIG. 4 (b-1)
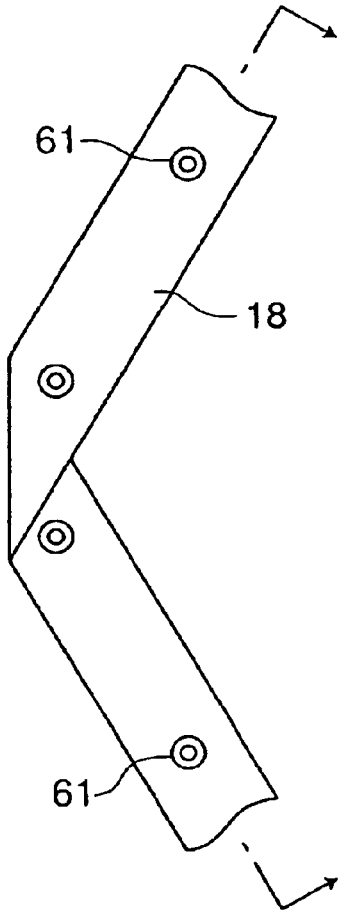
FIG. 4 (b-2)
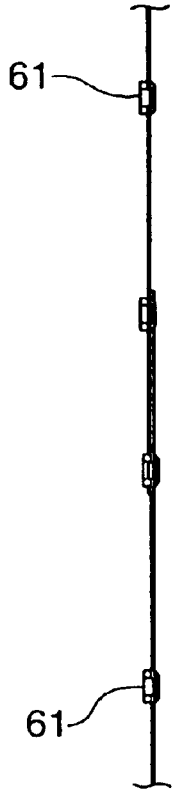

FIG. 5 (a-1)
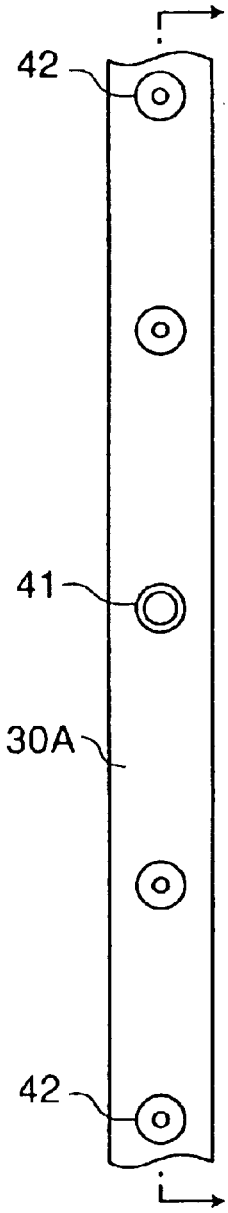
FIG. 5 (a-2)
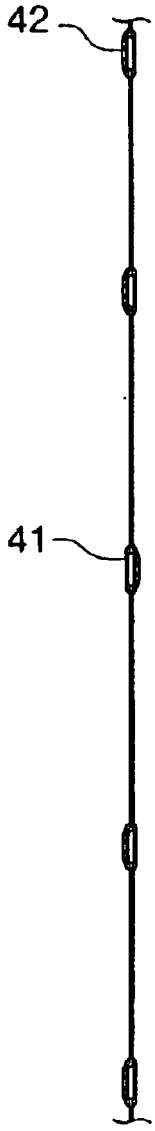
FIG. 5 (b-1)
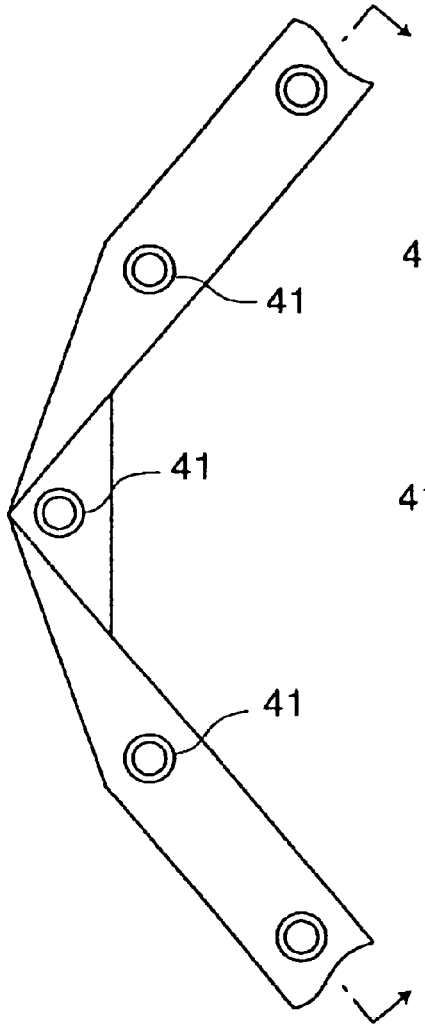
FIG. 5 (b-2)
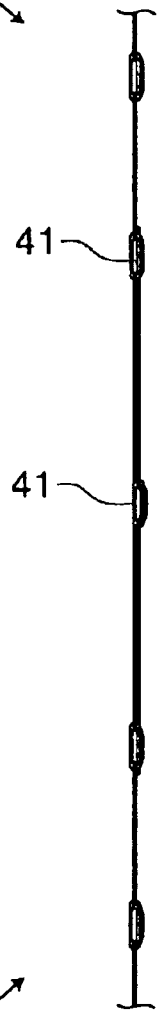

FIG. 6 (a-1)
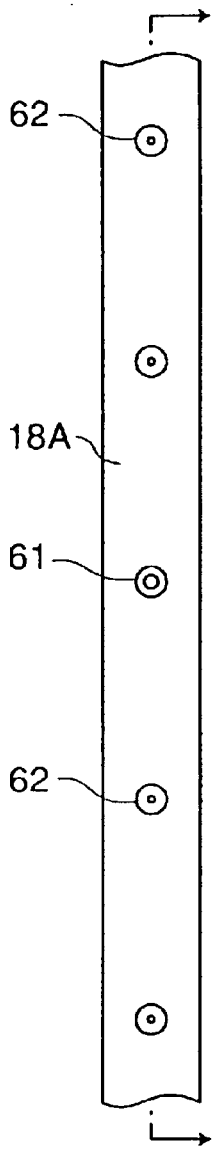
FIG. 6 (a-2)
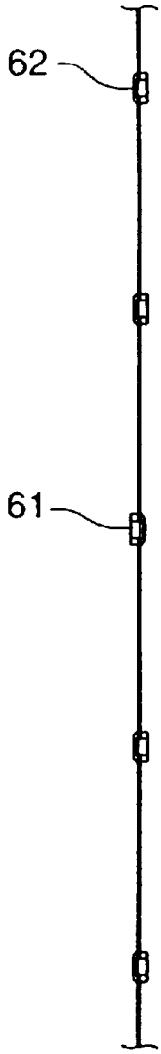
FIG. 6 (b-1)
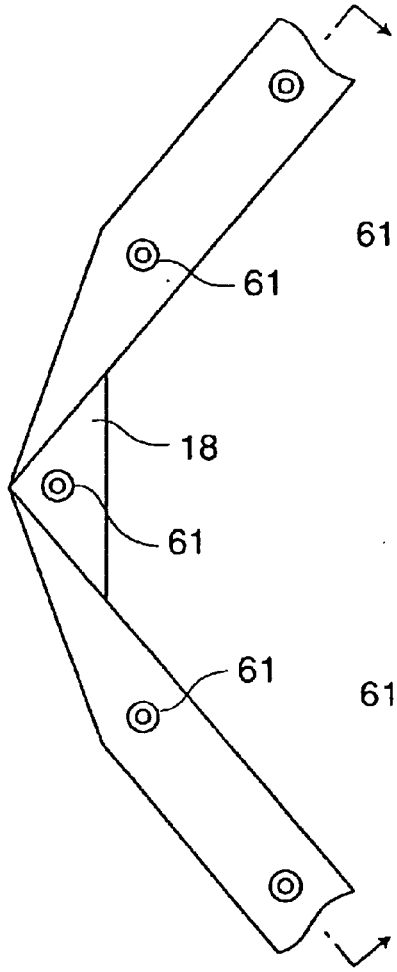
FIG. 6 (b-2)
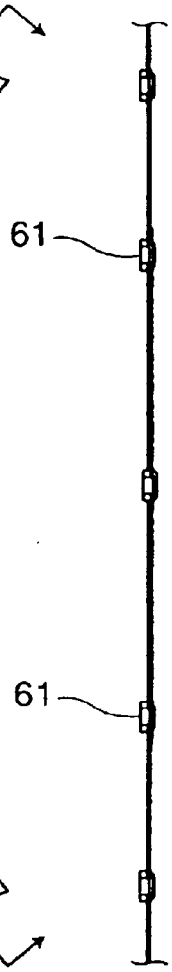

(a)

(b)

(a)

(b)

(a)

(b)

(a)

(b)

FIG. 13 (a-1) FIG. 13 (a-2) FIG. 13 (b-1) FIG. 13 (b-2)
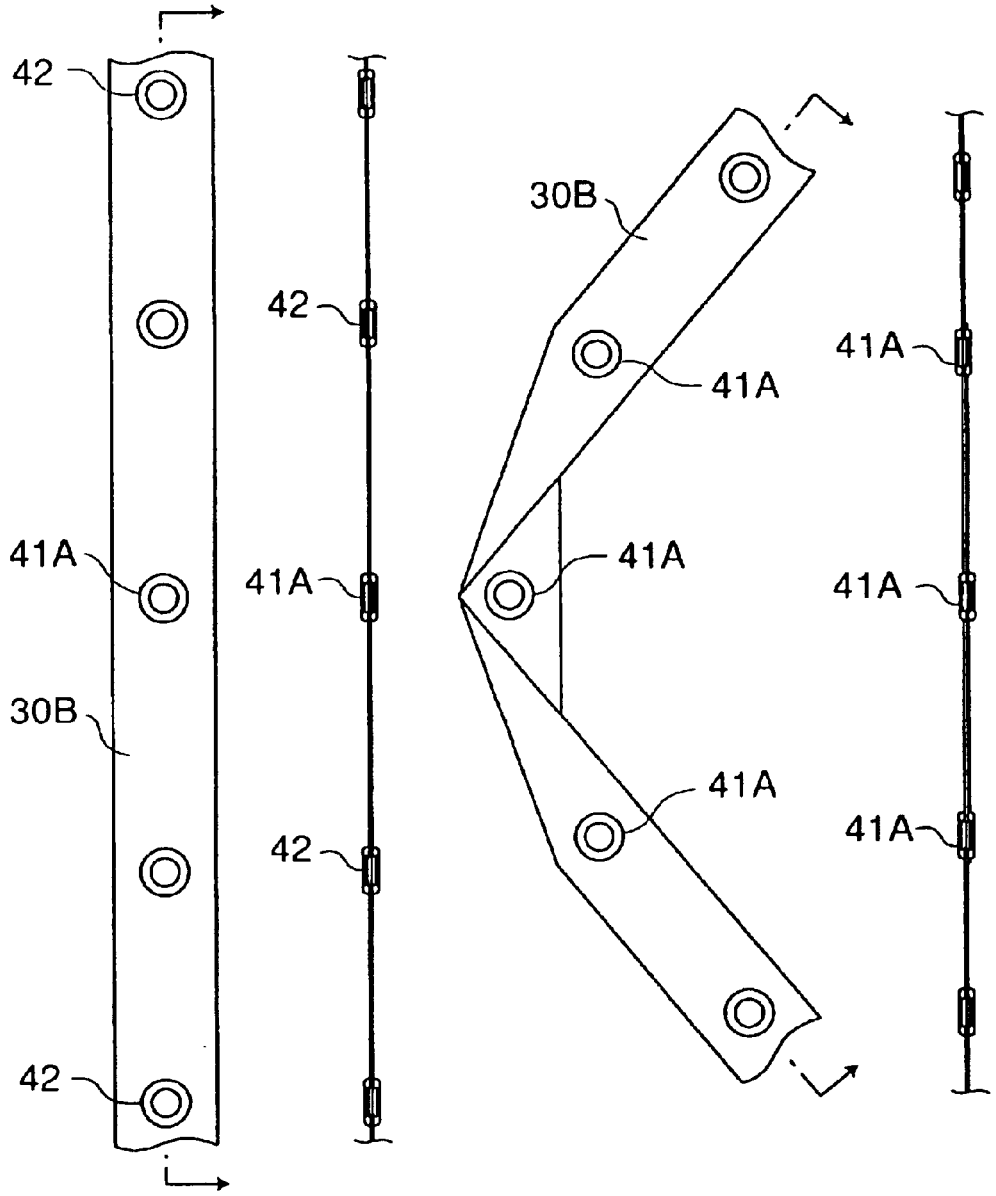

FIG. 14 (a-1) FIG. 14 (a-2) FIG. 14 (b-1) FIG. 14 (b-2)
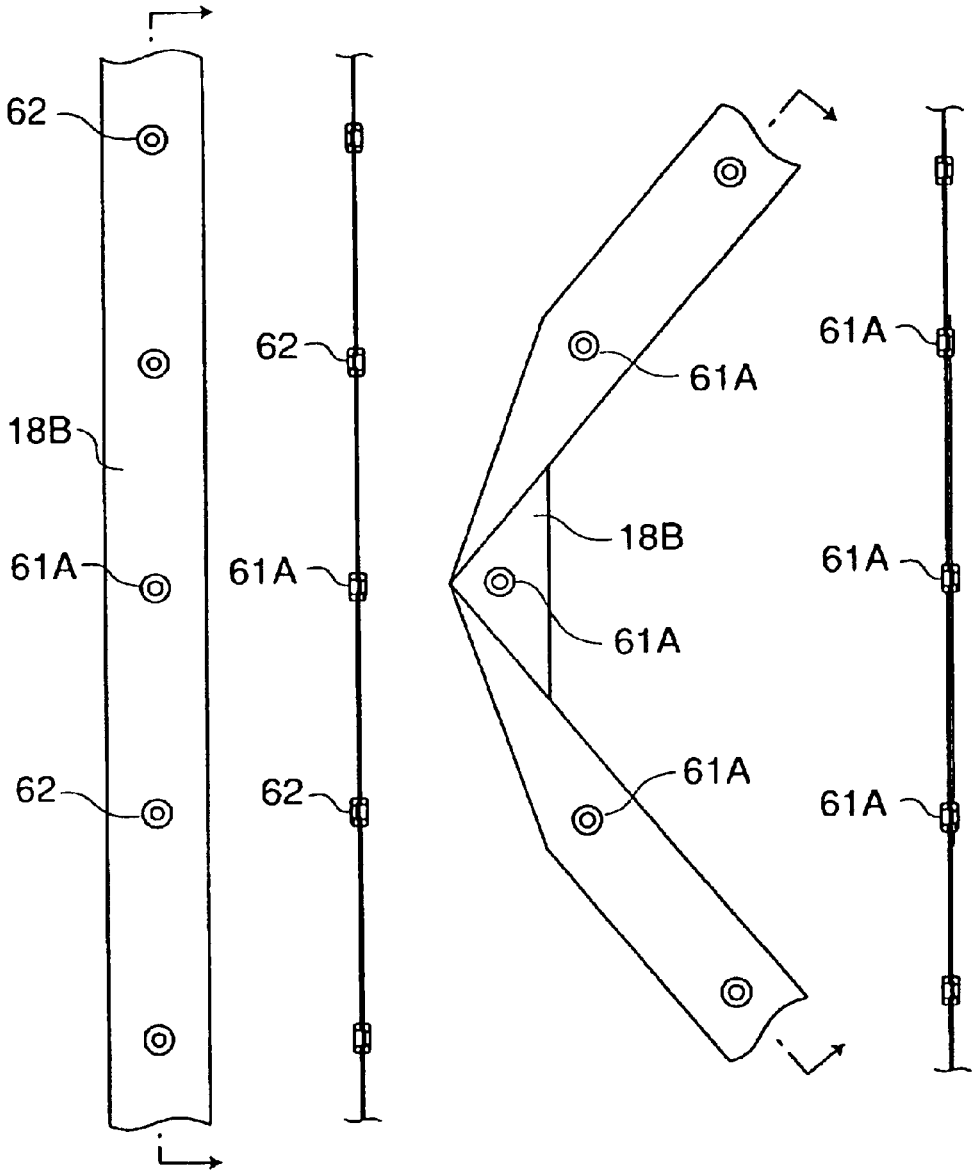

TAPE-MOUNTED FASTENER AND METHODS FOR MANUFACTURING AND USING THE SAME

FIELD OF THE INVENTION

The present invention relates to a tape-mounted fastener, which we simply call "tape fastener" henceforth, and methods for manufacturing and using the same.

BACKGROUND OF THE INVENTION

The applicant of the present invention disclosed a tape fastener as described in JP-A- 2001-149117, which corresponds to U.S. Pat. No. 6,314,621. This tape fastener comprises a male tape made of a cloth tape on either side of which several synthetic resin male parts are moulded and fastened at certain intervals and a female tape made of a cloth tape on either side of which several synthetic female parts are moulded and fastened at the same intervals as the male parts. The male parts and the female parts are moulded and fastened on the cloth tapes, which are not provided with mounting holes. Each of the male parts has an engagement protrusion that stands upright directly from the cloth tape without the aid of a base. The male and female parts are preferably ring-shaped viewed from the front or the back.

This fastener was accepted favourably by the market and used in a variety of products. Applications, however, were limited to rectilinear closures. For this reason, this tape fastener could not meet the requests for using it for curvilinear closures. Examples of curvilinear closures include the crotch part of a baby's clothes (see FIG. 1) and the front opening part of a baby's clothes that also functions as a bib (see FIG. 2).

SUMMARY OF THE INVENTION

The object of the present invention is to provide a tape fastener that can be used for curvilinear closures and methods for manufacturing and using the same.

The tape fastener of the present invention can be used for curvilinear closures such as the crotch part and the front opening part of a baby's clothes as described in claims 5 and 6.

BRIEF DESCRIPTIONS OF THE DRAWINGS

Embodiments of the present invention will now be described with reference to the accompanying drawings, in which:

FIG. 3(*a*-1) is a plan view of a female snap fastener tape according to the first embodiment of the present invention before it is processed, (*a*-2) is a cross sectional view of the same before it is processed, (*b*-1) is a plan view of the same after it is processed, and (*b*-2) is a cross sectional view of the same after it is processed;

FIG. 4(*a*-1) is a plan view of a male snap fastener tape according to the first embodiment of the present invention before it is processed, (*a*-2) is a cross sectional view of the same before it is processed, (*b*-1) is a plan view of the same after it is processed, and (*b*-2) is a cross sectional view of the same after it is processed;

FIG. 5(*a*-1) is a plan view of a female snap fastener tape according to the second embodiment of the present invention before it is processed, (*a*-2) is a cross section of the same before it is processed, (*b*-1) is a plan view of the same after it is processed, and (*b*-2) is a cross sectional view of the same after it is processed;

FIG. 6(*a*-1) is a plan view of a male snap fastener tape according to the second embodiment of the present invention before it is processed, (*a*-2) is a cross sectional view of the same before it is processed, (*b*-1) is a plan view of the same after it is processed, and (*b*-2) is a cross sectional view of the same after it is processed;

FIG. 13(*a*-1) is a plan view of a female snap fastener tape according to the third embodiment of the present invention before it is processed, (*a*-2) is a cross sectional view of the same before it is processed, (*b*-1) is a plan view of the same after it is processed, and (*b*-2) is a cross sectional view of the same after it is processed; and FIG. 14(*a*-1) is a plan view of a male snap fastener tape according the third embodiment of the present invention before it is processed, (*a*-2) is a cross sectional view of the same before it is processed, (*b*-1) is a plan view of the same after it is processed, and (*b*-2) is a cross sectional view of the same after it is processed.

DETAILED DESCRIPTION OF PREFERRED EMBODIMENTS

Figure 1:
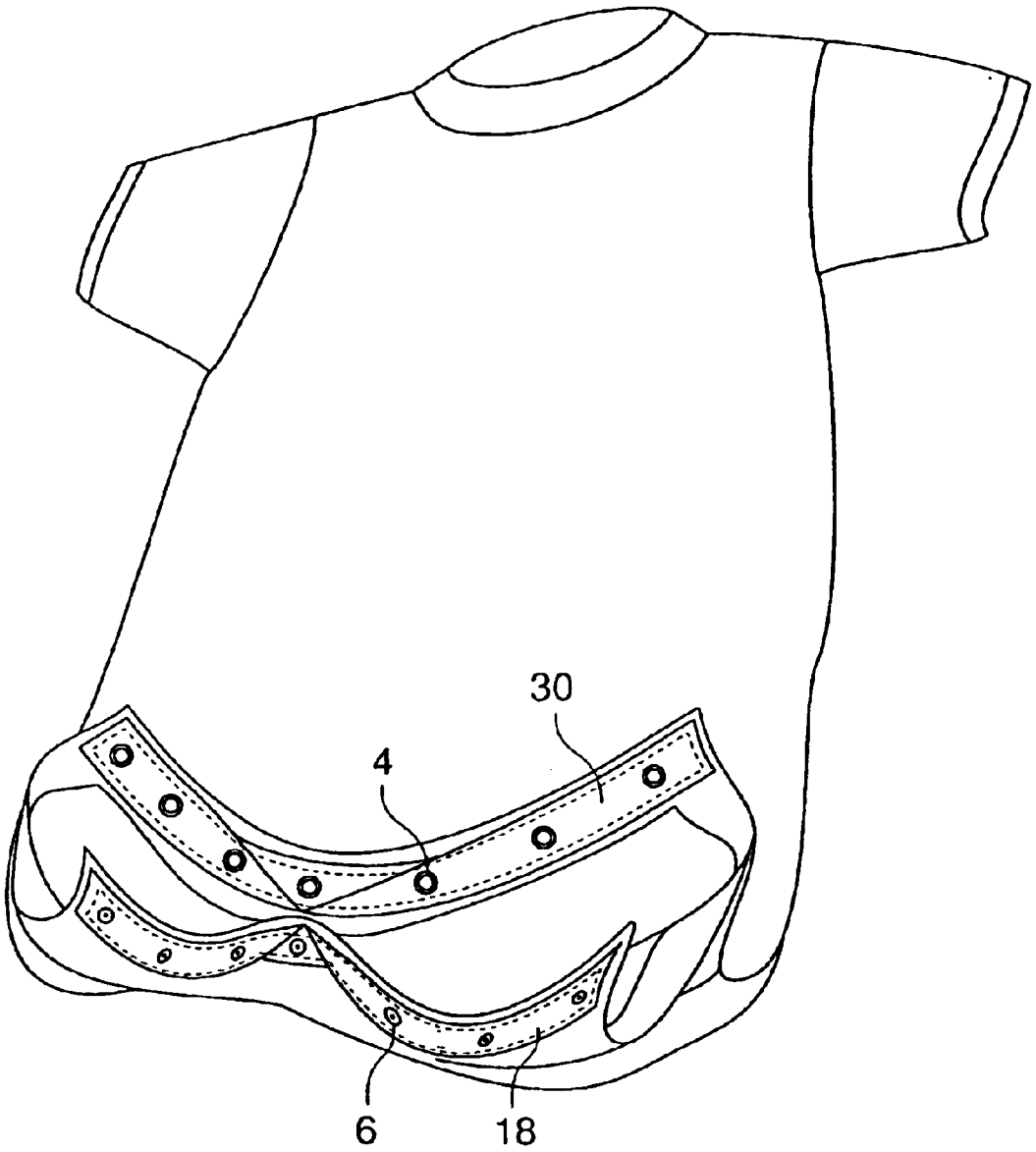
FIG. 1 shows an example in which the tape fastener of the present invention is used at the crotch part of a baby's clothes.
Figure 2:
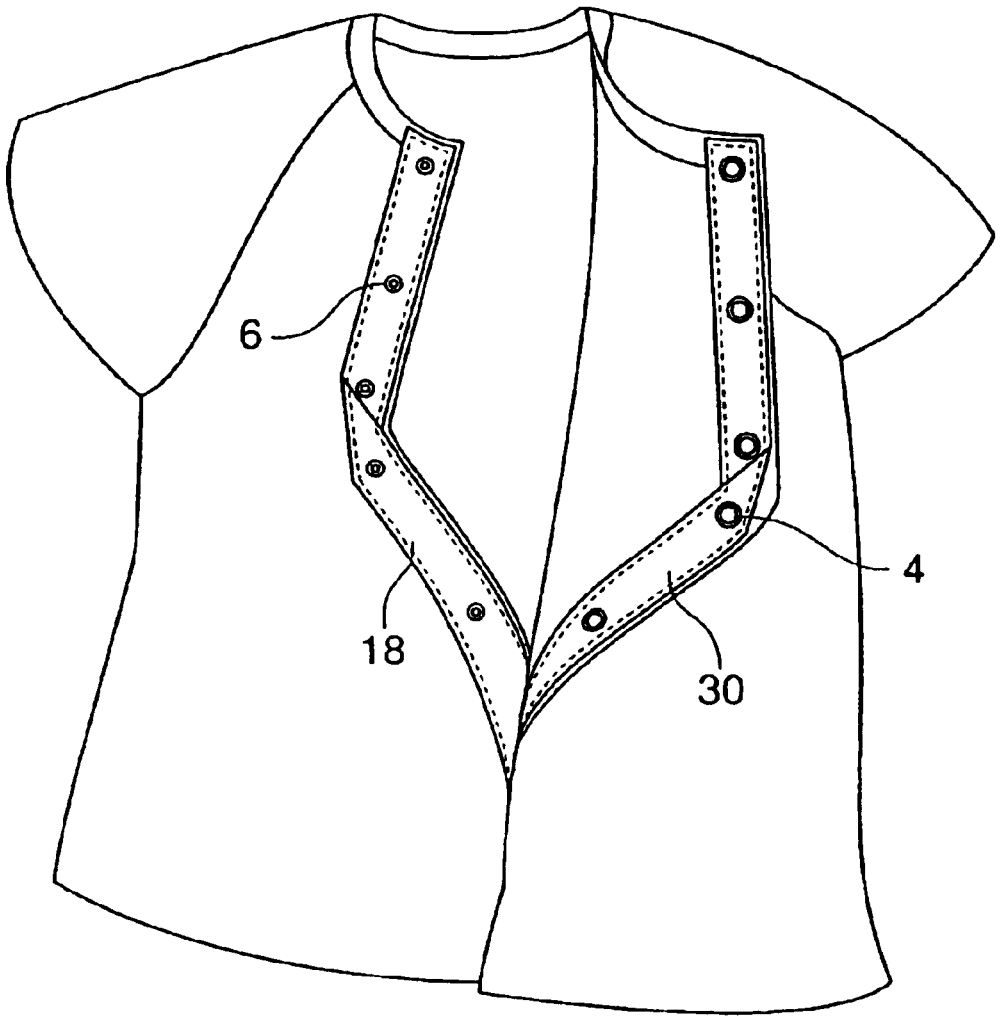
FIG. 2 shows an example in which the tape fastener of the present invention is used at the front opening part of a baby's clothes.

FIG. 1 shows an embodiment in which a tape fastener of the present invention is used at the crotch part of a baby's clothes. FIG. 2 shows an embodiment in which the same invention is used at the front opening part of a baby's clothes that also functions as a bib. Closures used at these parts are either arc-shaped or L-shaped. Because of this, the prior invention (JP-A-2001-149117) cannot be used as it is.

<First Embodiment>

FIG. 3 is a plan view of a female snap fastener tape according to a first embodiment of the present invention. The female snap fastener tape, which we simply call "female tape 30" henceforth, is made by moulding and fastening a plurality of synthetic resin female snaps 4 onto the front and back sides of a cloth tape. FIG. 3(*a*-1) is a plan view of the female tape 30 before it is processed, and FIG. 3(*a*-2) is a cross sectional view of the same. FIG. 3(*b*-1) is a plan view of the female tape 30 after it is processed, and FIG. 3(*b*-2) is a cross sectional view of the same. Of the four female snaps 4 shown in FIG. 3(*a*-1) and FIG. 3(*a*-2), the lower two are shown with their front sides (engagement sides) 41 up. The upper two, on the other hand, are shown with their back sides (non-engagement sides) 42 up. When the tape is folded as shown in (*b*-1) and (*b*-2), only the front sides (engagement sides) 41 come into view.

FIG. 4 is a plan view of a male snap fastener tape according to the first embodiment of the present invention. The male snap fastener tape, which we simply call "male tape 18" henceforth, is made by moulding and fastening a plurality of synthetic resin male snaps 6 onto the front and back sides of a cloth tape at the same intervals as the female snaps 4. FIG. 4(*a*-1) is a plan view of the male tape 18 before it is processed, and FIG. 4(*a*-2) is a cross sectional view of the same. FIG. 4(*b*-1) is a plan view of the male tape 18 after it is processed, and FIG. 4(*b*-2) is a cross sectional view of the same. Of the four male snaps 6 shown in (*a*-1) and (*a*-2), the lower two are shown with their front sides (engagement sides) 61 up. The upper two, on the other hand, are shown with their back sides (non-engagement sides) 62 up. When the tape is folded as shown in (*b*-1) and (*b*-2), only the front sides (engagement sides) 61 come into view.

Female snaps 4 of FIGS. 3(*b*-1, *b*-2) and male snaps 6 of FIGS. 4 (*b*-1, *b*-2) are designed to engage with each other. The tape fastener of the first embodiment can be used at a curved closure such as that in the front opening part of a baby's clothes as shown in FIG. 2.

<Second Embodiment>

FIGS. 5 and 6 relate to a second embodiment of the present invention. The difference between the first and second embodiments is that in the latter, the tape is folded twice rather than once. By increasing the number of times the tape is folded, it is possible to form a smoother arc than in the case of the first embodiment.

FIG. 5 is a plan view of a female snap fastener tape according to the second embodiment of the present invention. The female snap fastener tape, which we simply call "female tape 30A" henceforth, is made by moulding and fastening a plurality of synthetic resin female snaps 4 onto the front and back sides of a cloth tape. FIG. 5(*a*-1) is a plan view of the female tape 30A before it is processed, and FIG. 5(*a*-2) is a cross sectional view of the same. FIG. 5(*b*-1) is a plan view of the female tape 30A after it is processed, and FIG. 5(*b*-2) is a cross sectional view of the same. Of the five female snaps 4 shown in FIG. 5(*a*-1) and FIG. 5(*a*-2), the upper two and the lower two are shown with their back sides (non-engagement sides) 42 up. The middle one is shown with its front side (engagement side) 41 up. When the tape is folded twice, as shown in FIG. 5(*b*-1) and FIG. 5(*b*-2), only the front sides (engagement sides) 41 come into view.

FIG. 6 is a plan view of a male snap fastener tape according to the second embodiment of the present invention. The male snap fastener tape, which we simply call "male tape 18A" henceforth, is made by moulding and fastening a plurality of synthetic resin male snaps 6 onto the front and back sides of a cloth tape at the same intervals as the female snaps 4. FIG. 6(*a*-1) is a plan view of the male tape 18A before it is processed, and FIG. 6(*a*-2) is a cross sectional view of the same. FIG. 6(*b*-1) is a plan view of the male tape 18A after it is processed, and FIG. 6(*b*-2) is a cross sectional view of the same. Of the five male snaps 6 shown in FIG. 6(*a*-1) and FIG. 6(*a*-2), the upper two and the lower two are shown with their back sides (non-engagement sides) 62 up. The middle one is shown with its front side (engagement side) 61 up. When the tape is folded twice, as shown in FIG. 6(*b*-1) and FIG. 6(*b*-2), only the front sides (engagement sides) 61 come into view.

The female snaps 4 of FIG. 5(*b*-1, *b*-2) and the male snaps 6 of FIG. 6(*b*-1, *b*-2) are designed to engage each other. The fastener tape (comprising the female tape 30A and the male tape 18A) of the second embodiment can be used at a curvilinear closure (e.g., the crotch part of a baby's clothes) such as that shown in FIG. 2.

<Compositions of the Male and Female Snaps>

The compositions of the snaps used in the first and second embodiments are the same as those proposed by JP-A-2001-149117. Their compositions are described below with reference to FIGS. 7 to 9.

Figure 7:
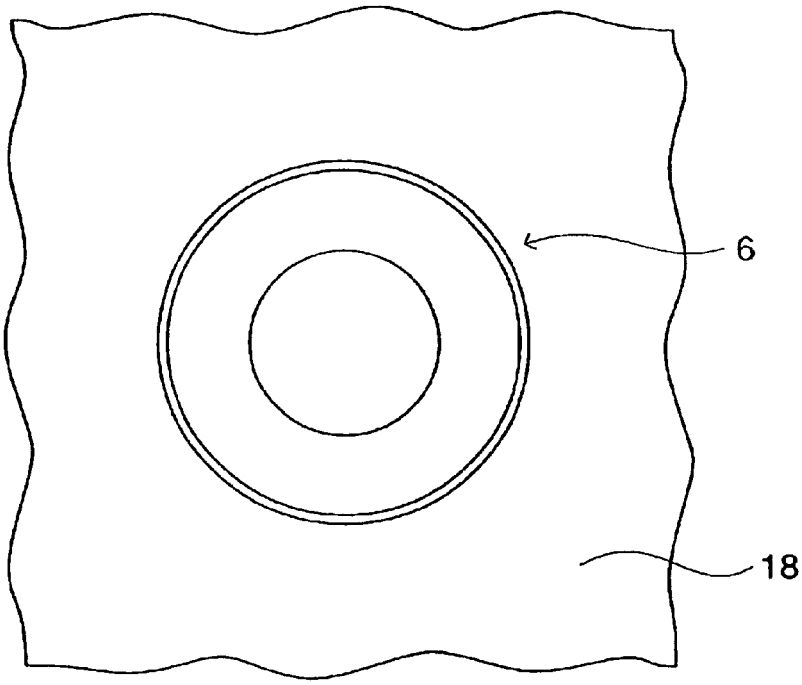
FIG. 7(*a*) is a plan view of a male snap 6, and (*b*) is a cross sectional view of the same.
Figure 7:
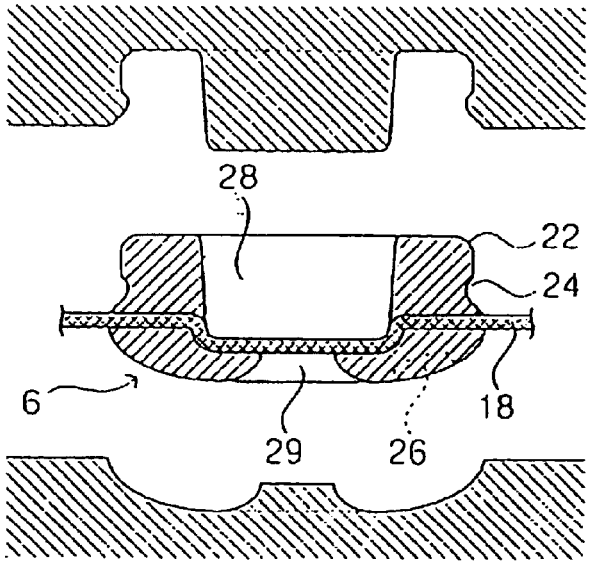

FIG. 7(*a*) is a plan view of a male snap 6 on a cloth tape 18, and FIG. 7(*b*) is a cross sectional view of the same. As shown in FIG. 7(*b*), the male snap 6 does not have a base. In the drawing, the part of the male snap 6 that joins the cloth tape 18 flares slightly, but this level of flare is not considered a base. If necessary, it is possible to eliminate the flare completely from the design. The male snap has an engagement protrusion 20 with a hollow 28 inside. The periphery of the engagement protrusion 20 is provided with a bulging rim 22 for engagement and a groove 24 to allow for inflationary or deflationary deformation caused by the elasticity of the resin material.

The male snap 6 is formed in the following process. A cloth tape 18 of a coarse texture that allows the penetration of molten resin under forming pressure is inserted between an upper die and a lower die (not shown) that are provided with a space for forming the fastener. The part of the cloth tape that is in the hollow 28 of the engagement protrusion 20 is clamped by the upper and lower dies, after which synthetic resin is injected into the space for forming the fastener. In FIG. 3, the small cavity indicated by numeral 26 corresponds to the injection port of the die. Because of the injection port, the width of the ring viewed from the back side is slightly larger than the width of the engagement protrusion 20 (i.e., the width of the ring viewed from the front side).

In this way, the front part and the back part of the male snap formed on either side of the cloth tape 18 are joined together by the synthetic resin that penetrates the cloth tape 18. Because the part of the cloth tape that is in the hollow 28 of the engagement protrusion 20 is clamped by the upper and lower dies, only a small area of the cloth tape is subjected to high injection pressure. Therefore, the tape is almost never warped or undulated by the injection pressure when the male snap is formed. As a result, it is possible to avoid the situation in which the tape emerges from the surface of the synthetic resin and reduces the strength and spoils the appearance of the fastener.

The tape cloth 18 needs to be made of a material that allows molten resin to penetrate through the material without melting it. Either a woven or knitted cloth, such as a cotton or blended yarn cloth can be used. For the synthetic resin, a thermoplastic resin, e.g., polyacetal molten resin can be used.

Figure 8:
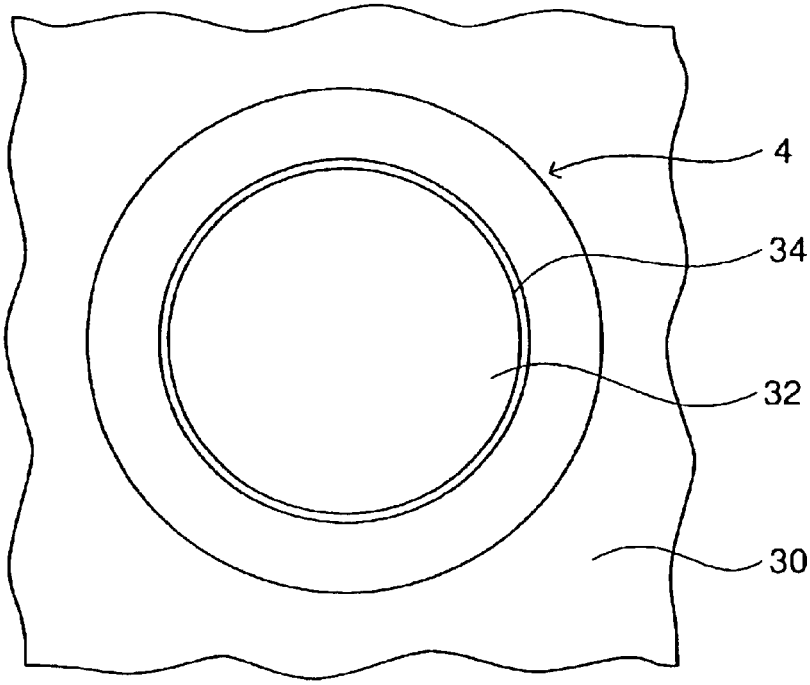
FIG. 8(*a*) is a plan view of a female snap 4, and (*b*) is a cross sectional view of the same.
Figure 8:
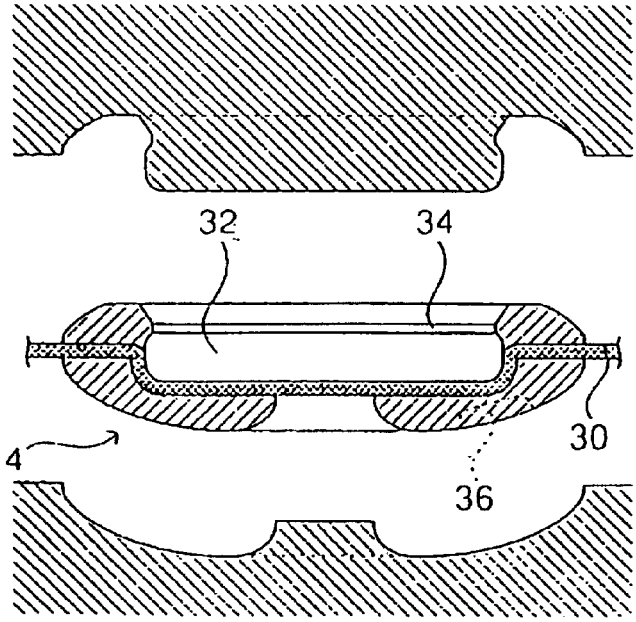

FIG. 8(*a*) is a plan view of a female snap 4 on a cloth tape 30, and FIG. 8(*b*) is a cross sectional view of the same. An engagement socket 32 is formed of synthetic resin that penetrates the cloth tape 30. An engagement rim 34 is formed inside the opening of the engagement socket 32 in such a way that it allows the male snap to be pushed into and taken out of the engagement socket 32.

The method for forming the female snap 4 is basically the same as that for the male snap 6. Accordingly, a detailed explanation will be skipped. The small cavity indicated by numeral 36 of FIG. 8(*b*) is the injection port.

Figure 9:
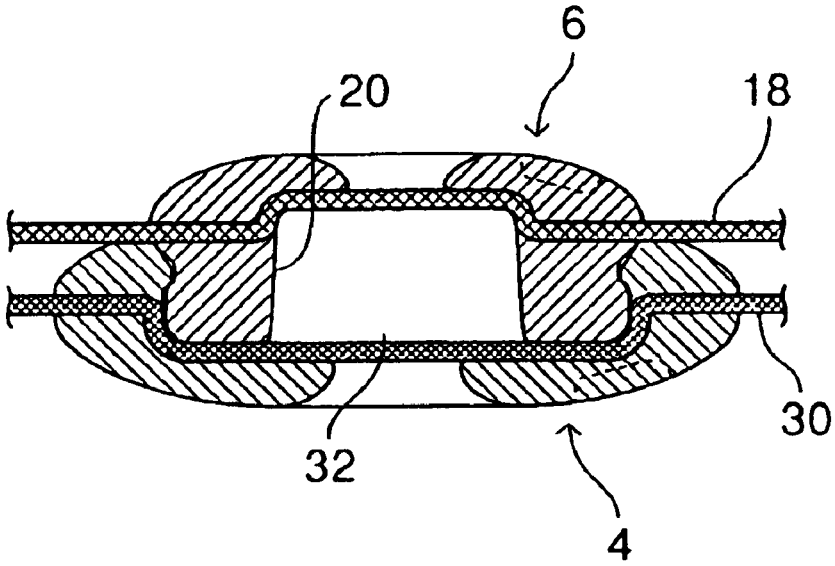
FIG. 9 is a cross sectional view of a male snap 6 and a female snap 4 as they are engaged.

FIG. 9 is a cross sectional view showing the condition in which the male snap 6 and the female snap 4 of the present invention are engaged with each other.

<Method for Manufacturing a Female Tape and a Male Tape of the First Embodiment>

The method for manufacturing a female tape 30 illustrated in FIG. 3(*a*-1, *a*-2) and a male tape 18 illustrated in FIG.

4(*a*-1, *a*-2) according to the present invention will now be explained. The following explanation applies to both the male and female tapes. The tape is moved between the upper and lower dies, and as the tape moves, the lower two snaps are injection-moulded. Then the tape is turned upside down and the upper two snaps are injection-moulded. After this, the tape is folded once in the middle to produce the condition illustrated in FIG. 3(*b*-1, *b*-2) for a female tape, or in FIG. 4(*b*-1, *b*-2) for a male tape. The folded part is preferably sewed together or bonded with adhesive.

<Method for Manufacturing a Female Tape and a Male Tape of the Second Embodiment>

The method for manufacturing a female tape 30A illustrated in FIG. 5(*a*-1, *a*-2) and a male tape 18A illustrated in FIG. 6(*a*-1, *a*-2) will now be explained. The following explanation applies to both the male and female tapes. The tape is moved between the upper and lower dies, and as the tape moves, the upper two snaps are injection-moulded. The tape moves on leaving a space for a middle snap, then the lower two snaps are injection-moulded. The tape is then turned upside down to injection-mould the middle snap. After this, the tape is folded twice near the middle to produce the condition illustrated in FIG. 5(*b*-1, *b*-2) for a female tape, or in FIG. 6(*b*-1, *b*-2) for a male tape. The folded part is preferably sewed together or bonded with adhesive.

<Third Embodiment>

According to the first and second embodiments, manufacturing of a tape fastener for curvilinear applications involves a process in which the tape is turned upside down. Making such a tape fastener without turning the tape upside down would require a side-by-side arrangement of two sets of upper and lower dies, which would further require a complicated mechanism to operate.

A third embodiment of the present invention relates to a method for manufacturing a snap fastener tape for curvilinear applications without turning the tape upside down using one set of upper and lower dies. The third embodiment relates also to a snap fastener tape manufactured in such a method. In order to manufacture a tape fastener for curvilinear applications using one set of upper and lower dies without turning the tape upside down, the front side and the back side of the tape fastener are designed as symmetric as possible. At least the engagement parts are given the same profile.

Figure 10:
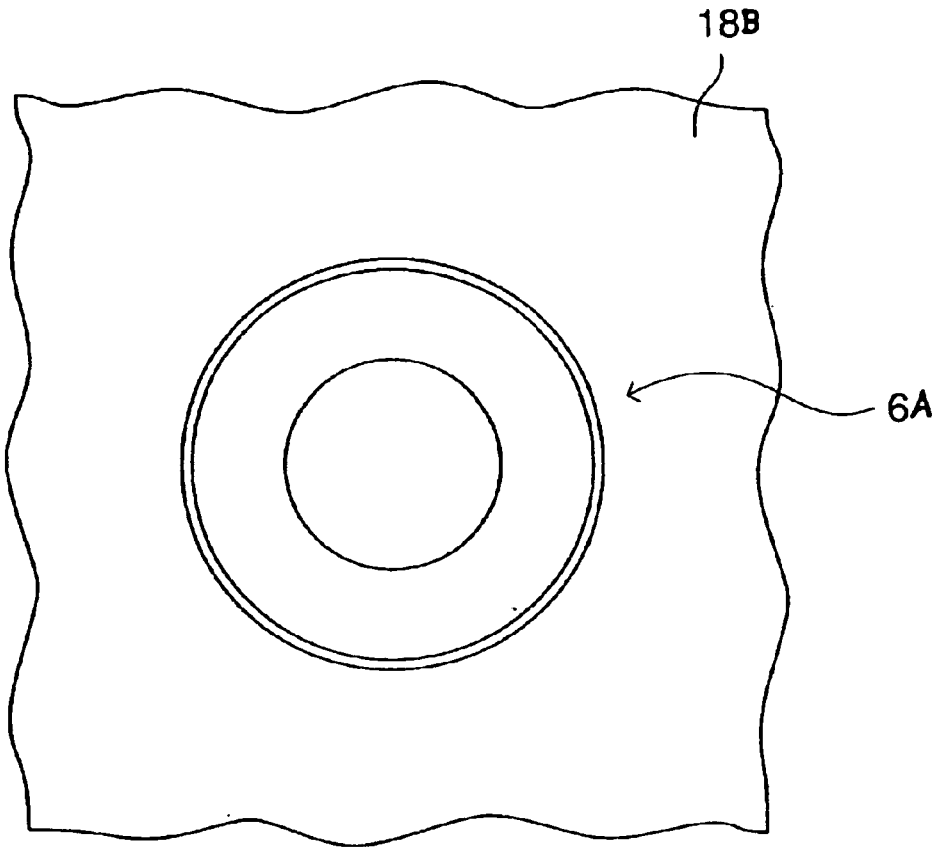
FIG. 10(*a*) is a plan view of a male snap 6A, and (*b*) is a cross sectional view of the same according to the third embodiment.
Figure 10:
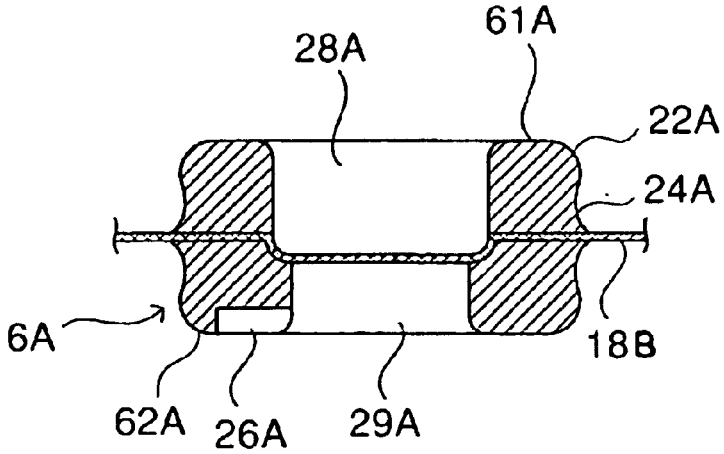

FIG. 10(*a*) is a plan view of a male snap 6A injection-moulded on a cloth tape 18B. FIG. 10(*b*) is a cross section of the same. As shown in FIG. 10(*b*), the male snap 6A does not have a base. In the drawing, the part of the male snap 6A that joins the cloth tape 18B flares slightly, but this level of flare is not considered a base. If necessary, it is possible to completely eliminate the flare from the design.

The male snap 6A has an engagement protrusion 20A that protrudes almost symmetrically on either side of the tape. In the drawing, the exterior contours of the upper and lower portions of the snap are almost symmetrical but the interior contours are not symmetrical. The upper opening 28A is slightly larger than the lower opening 29A. In other words, the upper portion has a thinner wall than the lower portion. It is designed as such in order to accommodate a resin-injection port 26A in the lower portion, but it is possible to design the upper and lower portions to be completely symmetrical.

The peripheries of the upper and lower portions are provided with bulging rims 22A for engagement and grooves 24 to allow for inflationary or deflationary deformation caused by the elasticity of the resin material.

In this way, the upper and lower portions of the male snap formed on either side of the cloth tape 18B are joined together by the synthetic resin that penetrates the cloth tape 18B. In the following explanation, we refer to the upper portion as "front side 61A" and the lower portion as "back side 62A". Because the part of the cloth tape that is between the upper opening 28A and the lower opening 29A is clamped by the upper and lower dies, only a small area of the cloth tape is subjected to high injection pressure. Therefore the tape is almost never warped or undulated by the injection pressure when the male snap is formed. As a result, it is possible to avoid the situation in which the tape emerges from the surface of the synthetic resin and reduces the strength and spoils the appearance of the fastener.

The tape cloth 18B needs to be made of a material that allows molten resin to penetrate through the material without melting it. Either a woven or knitted cloth, such as a cotton or blended yarn cloth can be used. For the synthetic resin, a thermoplastic resin, e.g., polyacetal molten resin can be used.

The male snap 6A is formed in the following process. A cloth tape 18B of a coarse texture that allows the penetration of molten resin under the forming pressure is inserted between an upper die and a lower die (not shown) that are provided with a space for forming the fastener. The part of the cloth that is between the upper opening 28A and the lower opening 29A inside the engagement protrusion 20 is clamped by the upper and lower dies, after which synthetic resin is injected into the space for forming the fastener. In FIG. 10, the small cavity indicated by numeral 26A corresponds to the injection port of the die.

Figure 11:
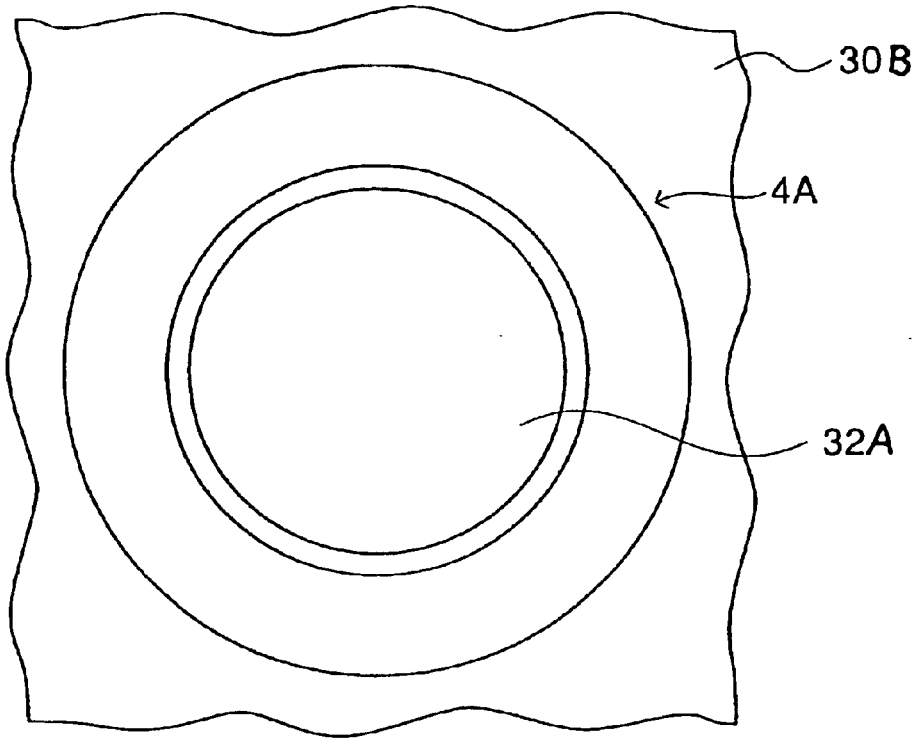
FIG. 11(*a*) is a plan view of a female snap 4A, and (*b*) is a cross sectional view of the same according to the third embodiment.
Figure 11:
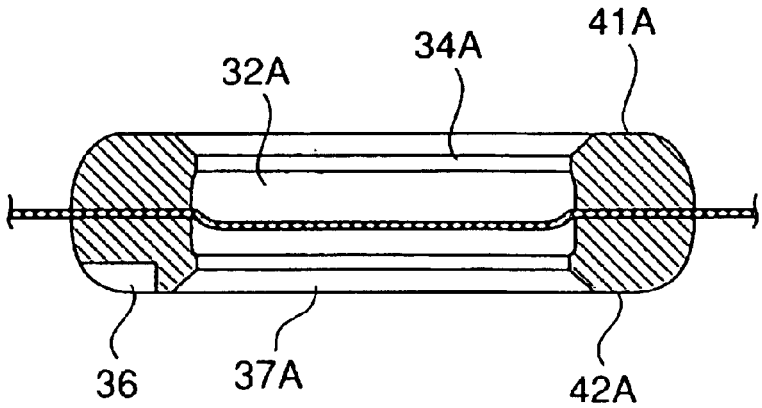

FIG. 11(*a*) is a plan view of a female snap 4A on a cloth tape 30B, and FIG. 11(*b*) is a cross sectional view of the same. Engagement sockets 32A, 37A are formed of synthetic resin that penetrates the cloth tape 30B. The engagement sockets 32A, 37A on the opposite sides of the tape 30B are virtually symmetrical. Engagement rims 34A and 38A are formed inside the openings of the respective engagement sockets in such a way that they allow the male snap to be pushed into and taken out of the engagement sockets 32A, 37A.

The method for forming the female snap 4A is basically the same as that for the male snap 6A. Accordingly, a detailed explanation will be skipped. The small cavity indicated by numeral 36A of FIG. 11(*b*) is the injection port.

Figure 12:
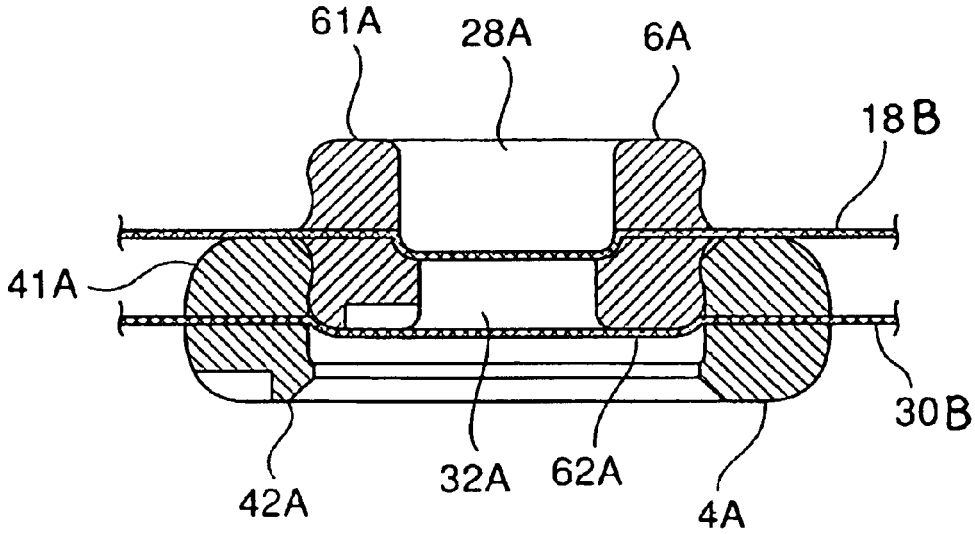
FIG. 12 is a cross sectional view of a male snap 6A and a female snap 4A as they are engaged.

FIG. 12 is a cross sectional view showing the condition in which the male snap 6A and the female snap 4A of the present invention are engaged with each other. It is evident from the above explanation that the male snap 6A can be engaged with the female snap 4A using its front side 61A or back side 62A. In the same way, the female snap 4A can be engaged with the male snap 6A using its front side 41A or back side 42A.

FIG. 13 is a plan view of a female snap fastener tape according to the third embodiment of the present invention. The female snap fastener tape, which we simply call "female tape 30B" henceforth, is made by moulding and fastening a plurality of synthetic resin female snaps 4A onto the front and back sides of a cloth tape. (*a*-1) is a plan view of the female tape 30B before it is processed, and (*a*-2) is a cross sectional view of the same. (*b*-1) is a plan view of the female tape 30B after it is processed, and (*b*-2) is a cross sectional view of the same. Of the five female snaps 41A shown in (*a*-1) and (*a*-2), the upper two and the lower two are shown with their back sides 42A up. The middle one is shown with its front side 41A up. When the tape is folded twice, as shown in (*b*-1) and (*b*-2), only the front sides 41A come into view. But as mentioned earlier, the female snap 4A can be engaged with the male snap 6A using its front side 41A or back side 42A. As such, it does not matter how many times the tape should be folded, or whether it should be folded at all.

FIG. 14 is a plan view of a male snap fastener tape according to the third embodiment of the present invention. The male snap fastener tape, which we simply call "male tape 18B" henceforth, is made by moulding and fastening a plurality of synthetic resin male snaps 6A onto the front and back sides of a cloth tape at the same intervals as the female snaps 41A. (*a*-1) is a plan view of the male tape 18B before it is processed, and (*a*-2) is a cross sectional view of the same. (*b*-1) is a plan view of the male tape 18B after it is processed, and (*b*-2) is a cross sectional view of the same. Of the five snaps 6A shown in (*a*-1) and (*a*-2), the upper two and the lower two are shown with their back sides 62A up. The middle one is shown with its front side 61A up. When the tape is folded twice as shown in (*b*-1) and (*b*-2), only the front sides (engagement sides) 61A come into view. But as mentioned earlier, the male snap 6A can be engaged with the female snap 4A using its front side 61A or back side 62A. As such, it does not matter how many times the tape should be folded, or whether it should be folded at all.

<Method for Manufacturing a Tape Fastener of the Third Embodiment>

Unlike the first and second embodiments, the third embodiment does not require the tape to be turned upside down when manufacturing it. All snaps can be injection-moulded from the same side of the tape. After all snaps are formed on the tape, the tape is folded once, twice or more, as in the first and second embodiments, to create a non-rectilinear tape fastener, e.g., a polygonal, arc, circular or spiral tape fastener. Although polygonal, circular and spiral tape fasteners can also be produced according to the first and second embodiments, arranging the engagement sides on one side is such a tricky work that it is probably avoided.

What is claimed is:

1. A tape-mounted fastener comprising:

a male tape comprising a plurality of synthetic resin male snaps moulded and fastened onto a cloth tape at certain intervals in such a way that their engagement sides and non-engagement sides, which are asymmetric to each other, are on the front side and the back side of the cloth tape respectively, said engagement sides and the non-engagement sides of the male snaps coexisting on both the front side and the back side of the male tape, and a female tape comprising a plurality of synthetic resin female snaps moulded and fastened onto a cloth tape at the same intervals as the male snaps in such a way that their engagement sides and non-engagement sides, which are asymmetric to each other, are on the front side and the back side of the cloth tape respectively, said engagement sides and the non-engagement sides of the female snaps coexist on both the front side and the back side of the female tape.

2. A tape-mounted fastener according to claim 1, wherein said tape fastener is folded at least once to make it into a non-rectilinear tape fastener, in which the engagement sides and the non-engagement sides of the female and male snaps are all arranged on the same side.

3. A tape-mounted fastener comprising:

a male tape comprising a plurality of synthetic resin male snaps moulded and fastened onto a cloth tape at certain intervals in such a way that a first engagement side and a second engagement side of each male snap are on the front side and the back side of the cloth tape respectively, said first engagement side and the second engagement side of the male snap having the same exterior contour, and a female tape comprising a plurality of synthetic resin female snaps moulded and fastened onto a cloth tape at the same intervals as the male snaps in such a way that a first engagement side and a second engagement side of each female snap are on the front side and the back side of the cloth tape respectively;

said first engagement side and the second engagement side of the female snap having the same interior contour.

4. A tape-mounted fastener according to claim 3, wherein said tape fastener is folded at least once to make it into a non-rectilinear tape fastener.

5. Clothing provided with a tape-mounted fastener according to claim 1 at its crotch part.

6. Clothing provided with a tape-mounted fastener according to claim 1 at its front opening part.

7. Clothing provided with a tape-mounted fastener according to claim 3 at its crotch part.

8. Clothing provided with a tape-mounted fastener according to claim 3 at its front opening part.

* * * * *